United States Patent [19]

Bush

[11] 3,939,565

[45] Feb. 24, 1976

[54] PATTERN FITTING TOOL AND METHOD OF CUSTOM FITTING PATTERS

[76] Inventor: Roberta F. Bush, 232 Sierra Drive, Walnut Creek, Calif. 94596

[22] Filed: Apr. 22, 1974

[21] Appl. No.: 462,756

Related U.S. Application Data

[62] Division of Ser. No. 832,043, June 11, 1969, Pat. No. 3,883,955.

[52] U.S. Cl. ..... 33/17 R

[51] Int. Cl.[2] ..... A41H 3/04

[58] Field of Search ..... 33/17 R, 12

[56] References Cited

UNITED STATES PATENTS

| | | | |
|---|---|---|---|
| 2,892,196 | 6/1959 | Pundyk | 33/12 X |
| 3,257,727 | 6/1966 | Berlin | 33/12 |

FOREIGN PATENTS OR APPLICATIONS

| | | | |
|---|---|---|---|
| 362,051 | 12/1931 | United Kingdom | 33/12 |
| 283,032 | 9/1952 | Switzerland | 33/2 R |

OTHER PUBLICATIONS

Farmer's Bulletin No. 1968, U.S. Dept. of Agriculture, Apr. 1945, pp. 1–13.

Walker's Basic Pattern Measure 1954.

*Primary Examiner*—Richard E. Aegerter

*Assistant Examiner*—Charles E. Phillips

[57] ABSTRACT

A plastic pattern form for customized fitting a person, comprising plastic sheet material having basic patterns printed thereon with the pattern indicating certain reference positions and lines for accurate placement of the pattern on the person together with indicated darts and seams ordinarily designed to go with the size pattern, and numbers indicating possible figure variations from the norm that will require size changes within the body of the pattern itself rather than at the seam lines; and a method of providing customized fitting utilizing said plastic pattern form, which comprises the steps of, attaching tapes to the figure being fitted including a chest tape extending around the figure and through the underarm areas, a waist tape extending around the waistline and a hip tape extending around the hips and through the high round areas of the seat, measuring the horizontal and vertical distances from reference points and the tapes to indicate distances to seam lines, laying said measurements plus standard allowances over the plastic sheet material and indicating areas of adjusted seam positions, altering the size of the pattern when necessary to correct certain unusual figure measurements so that the measured seam will fall close to the indicated probable seam on the plastic pattern, placing the pattern over the figure with matched reference positions and pinning the plastic to the tape with the darts and seams of the pattern pinned to indicate the proper darts and seam lines, and marking said seam lines and darts to indicate a customized three dimensional fit on the two dimensional plastic patterns, and altering a paper pattern selected for making a garment so as to have its seam lines and darts correspond with those of the plastic pattern together with style allowances, whereby paper patterns may be corrected both internally and at the seams in order to indicate the proper cut for customized fitting.

2 Claims, 59 Drawing Figures

PATTERN FITTING TOOL AND METHOD OF CUSTOM FITTING PATTERS

This application is a divisional application of my co-pending application Ser. No. 832,043, filed June 11, 1969, which application issued May 20, 1975 as Pat. No. 3,883,955.

BACKGROUND OF THE INVENTION

The present invention relates to a PATTERN FITTING TOOL AND METHOD OF CUSTOM FITTING PATTERNS, and more particularly to a pattern fitting tool and method of utilizing same which is suitable for correcting paper patterns prior to cutting in order to achieve a proper fit.

The art of dressmaking is well known, and garments are standardized, more or less, as to shape and sized from small sizes to large sizes in order to provide a range of garments suitable for a variety of different individuals. However, individual vary in certain specific areas from the standard or normal and standard garments therefore do not provide the desired fit. In some cases, the fit is rather close, and reasonably good fitting can be achieved simply by seam alteration. However, large deviations cannot be properly corrected by seam adjustment and individuals with one or more large variations from the norm simply cannot be properly fit from standard garments.

With the advent of dressmaking, the art is exceedingly tempting for individuals having such deviations that good fits are not proper from standard garments. However, when such individuals purchase and utilize patterns, the patterns are standard and tend to lead toward the same garment with the same problems as that obtained by standard constructions. Once again, the dressmaker will attempt to overcome these variations by seam changes, but the seam changes do not provide the desired fit.

These standard garments are laid out with darts and ease positions together with expected seam lines that will provide two dimensional cuts to fit the standard three dimensional figure and these standards are exceedingly well developed for accurate fitting. However, there has been no effective tool for the home dressmaker to provide his or her own standard whereby optimum contours are built into the pattern form so as to provide the proper conversion from the three dimensional figure to the two dimensional fabric pieces desirable for specific individuals having one or more variation from the norm.

In order to assist the home dressmaker, dressmaking forms have been developed, and these forms are excellent for indicating the three dimensional side of the human figure and assist in indicating the problem area. However, the dressmaking form simply illustrates the three dimensional contour while the pattern is still a two dimensional indication with conversions made according to a standard. Accordingly, a proper tool for the home dressmaker is converting from this three dimensional figure to be fitted to the two dimensional fabric pieces to be cut is still lacking.

SUMMARY OF THE INVENTION

It is a primary object of the invention to provide a fitting tool whereby a conversion from the three dimensional contours of an individual to be fit may be converted to the two dimensional pattern pieces to be cut, and in which the darts and eases and other assists for correct contours are coordinated with the seam lines so as to enable the dressmaker to provide the conversion and make a garment having straight seams as well as proper contours with a minimum of final alteration.

In accordance with the invention, this tool comprises a plastic pattern form having basic pattern sections printed thereon in accordance with a standard, but formed for providing a changeable pattern to be altered to fit the figure. The printed pattern comprises a plurality of fixed reference points formed to locate the pattern on the person and oriented in the proper vertical and horizontal positions, and a plurality of correctable markings indicating areas for locating darts and seams. The pattern also contains a list of reference numbers that should be checked for special figure problems and the pattern size altered in accordance with techniques illustrated and explained in a book of directions provided with the pattern form in order to readjust the pattern from the standard to the desired form.

In its method form, the invention provides a procedure for utilizing the plastic pattern form of this invention and converting from the three dimensional figure of the person being fitted directly to the two dimensional layout on the paper pattern in order to achieve proper cutting. The preferred procedure of the invention comprises the steps of cutting each pattern section from the plastic sheet material with the cuts being oversized from the indicated probable seam lines, for example a typical plastic pattern will have a front bodice, rear bodice, front skirt, rear skirt and sleeve. The person to be fitted should preferably analyze her figure, note the figure problem numbers applicable to her, and mark them so that deviations from the standard in this area will have its proper cause indicated.

Three pieces of elastic tape are then attached to the figure being fitted including a chest tape extending circumferentially around the figure and through the underarm areas, a waist tape extending circumferentially around the waist line, and a hip tape extending circumferentially around the hips and through the high areas of the seat. The elastic tape shold be marked at center front and back to show pinning and measuring positions and the side seam position should also be marked to indicate generally the desired straight seam position. A tape, chain or beads are fastened around the neck to determine neck base, and the shoulder line from the neck to the shoulder is marked directly on the skin of the person being fitted with a felt pen.

Basic measurements are then taken to measure the lengths and widths of certain key areas of the figure and these lengths and widths plus standard allowances are laid out on the pattern form to indicate certain corrected seam line positions. Where the corrected seam line positions are rather close to the indicated seam line positions, the figure being fitted has a body contour sufficiently close to the standard in all areas that simple seam adjustment will be satisfactory. However, very few figures will not deviate from the standard in at least one of the various problem areas of deviation.

For example, the length of the bodice may be altered from the reference position of the bust simply by having a high bust and requiring the pattern to be shortened above the bust and lengthened below the bust. Although the overall length would be the same as standard, it is seen that the seam lines would either be out of position, or the bust reference point would be out of position and thereby destroy the proper fit. In such a case, the plastic pattern is simply lenghtened in the necessary location and shortened in the other location so as to align the seams and bust position in the proper length orientation.

The measuring procedure is thus utilized to provide lengths, widths and so forth on all of the pattern pieces and general deviations or changes in dimensions are located in this way. Special problems require special pattern alteration and these will be indicated by large deviations of the measured from the indicated standard seams in certain areas. In this way, the markings noted analytically as mentioned above are confirmed or denied. Instructions for enlarging or reducing the pattern so as to provide the adjusted darts and seams in the proper position are given in the instruction book. In this way, the plastic pattern is adjusted to fit contours so that people with unusual figures can have fits of the same order of excellence that the mythical person with a standard figure would achieve with a standard pattern. After the plastic pattern has been initially marked and readjusted as to size so as to approximate the figure measured, it is actually put on, pinned to the tape in the proper orientation with reference positions matched, and seam lines as they actually appear on the figure marked in colored ink or the like. similarly, darts are pinned and marked so that exact fitting is achieved in the plastic pattern as worn on the person being fitted.

Since the plastic pattern may be flattened out again in sheet form, and is constructed similar to the paper patterns generally utilized, the plastic pattern is then used as a guide to alter the size of a selected paper pattern. When matching the paper and plastic patterns, style differences are added in accordance with conventional procedure, so that seam lines can be indicated on the pattern and the fabric cut with the desired seam allowances. In this way, the pattern pieces are accurately cut on the fabric to provide the final garment with the seam lines of the fabric being sufficiently closely matched to the individual that final alteration may easily be made in the seams during the usual fitting steps; the final alteration being required because of the different characteristics of different fabrics.

From the above description, it is seen that another object of the invention is to provide a plastic fitting tool of the character described which is especially suitable to fit a human figure when such figure has one or more of a number of rather extreme deviations from the standard so that standard patterns do not provide the desired fit.

Still another object of the invention is to provide a plastic fitting tool of the character described which will provide an improved fit for figures, even when no special fitting problem is present.

A further object of the invention is to develop a fitting tool and procedure for using same in which a person is fitted by the simple operations of measuring, marking, and trying on so that preliminary adjustments can be made for shaping the pattern tool and final adjustments can be made by actual trying on whereby customized fitting is available to even the relatively inexperienced home dressmaker.

Still another object of the invention is to provide a fitting tool and method of using same of the character described, in which each side of the person being fitted is fitted separately so that even relatively slight deviations from side to side such as high shoulders will be properly fitted and the problems caused by the usual pattern symmetry eliminated. Yet still another object of the invention is the provision of a tool and procedure for altering regular selected paper patterns prior to their use in cutting material for achieving an excellent custom fit in the garment made therefrom.

Further objects and advantages of the invention will be apparent as the specification proceeds and the new and useful features of the PATTERN FITTING TOOL AND METHOD OF CUSTOM FITTING PATTERNS using same will be more clearly defined in the claims attached hereto.

BRIEF DESCRIPTION OF THE DRAWINGS

The preferred form of the invention is illustrated in the accompanying drawings, forming a part of this description, in which.

While only the preferred form of the invention is shown and described in detail, it should be understood that various changes or modifications may be made within the scope of the claims attached hereto without departing from the spirit of the invention.

DESCRIPTION OF THE PREFERRED EMBODIMENT

Figure 1:
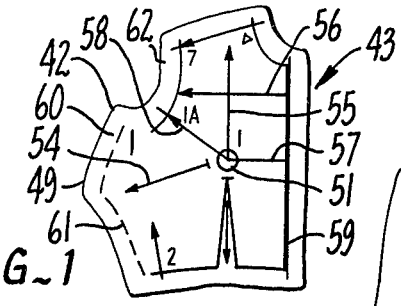
FIG. 1 is a plan view illustrating a section of plastic sheet having a pattern indicating a front bodice and constructed according to the invention.
Figure 2:
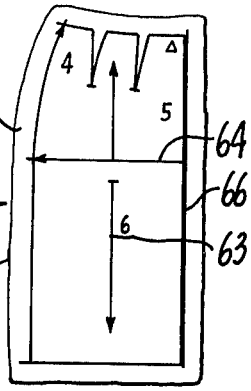
FIG. 2, a plan view of a plastic pattern constructed according to the invention and showing a front skirt section.
Figure 3:
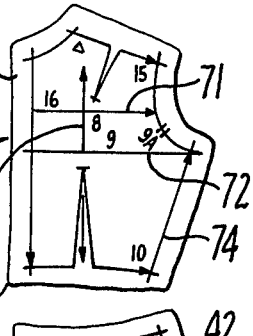
FIG. 3, a plan view of a back bodice pattern imprinted on a plastic sheet in accordance with this invention.
Figure 4:
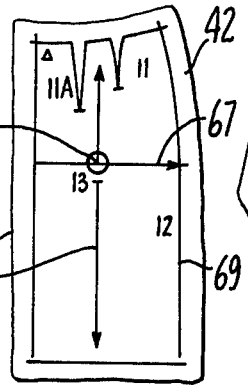
FIG. 4, a plastic sheet containing a pattern of a back skirt section constructed according to the invention.
Figure 5:
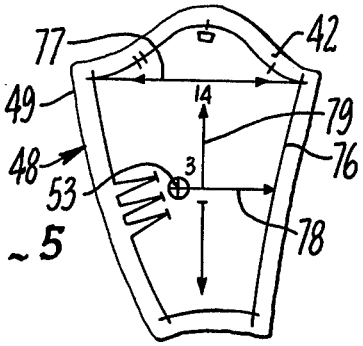
FIG. 5, a plan view of a sleeve pattern constructed according to the invention and formed for matching the patterns of FIGS. 1 through 4, which are also formed for fitting with each other.

Referring to the drawing in greater detail, and more particularly to FIGS. 1 through 5, there is shown a plurality of pattern sections each laid out on plastic sheet material, and with the pattern sections providing a basic cover for one side of a human figure. The other side of the human figure is provided simply by taking the same pattern sections and turning them over. Thus, FIG. 1 shows a plastic sheet 42 having a front bodice 43 imprinted thereon, FIG. 2 shows a plastic sheet 42 having a front skirt 44 imprinted thereon, FIG. 3 shows a plastic sheet 42 having a back bodice 46 imprinted thereon, FIG. 4 shows a plastic sheet 42 having a back skirt 47 imprinted thereon, and FIG. 5 shows a plastic sheet 42 having a sleeve 48 imprinted thereon.

As here shown, the plastic sheet 42 has been cut along lines 49 so as to provide separate pieces for each of the patterns of FIGS. 1 through 5, but it will be appreciated that the original article will usually have all of the patterns printed on one or two sheets 42. Regardless of how many sheets 42 are provided, the patterns should be cut as indicated as in line 42 so that each piece will be separate, the cut line being sufficiently distant from the indicated seam line that proper adjustments of seam may be made. In addition, the scraps of plastic that will be provided when the sheet 42 is cut may be utilized for enlargement of the pattern, if necessary.

As is apparent from FIGS. 1 through 5, the basic printed patterns have a plurality of fixed reference points marked on the pattern and formed to locate the pattern on the person and a plurality of correctable markings indicating areas for locating darts and seams in accordance with the shape of the person being fitted. Thus FIG. 1 contains a fixed reference point 51 indicating the high round of the bust, FIG. 4 contains a fixed reference 52 indicating the high round of the seat, and FIG. 5 indicates a fixed reference point 53 indicating the high round of the elbow. In addition, vertical and horizontal lines are provided to assist in alignment and fixed dart locations are indicated, all of which come within the broad form of fixed reference points. The correctable markings include the seam lines, actual size of the various darts, and the floating dart 54 indicated in FIG. 1.

Referring more particularly to FIG. 1, it is seen that the pattern 43 also contains fixed reference lines radiating from the high round of the bust 51, with vertical line 55 indicating vertical alignment, and providing for measurement of vertical distances, horizontal lines 56 and 57 similarly indicating alignment and measurement locations to seam, and diagonal line 58 also indicating a measurement from the fixed reference point 51 to the sleeve seam. Pattern 43 also has an indicated seam line 59, which is one of the adjustable reference markings, and placed thereon in accordance with standard figure measurement in order to provide the most likely beginning point for seam lines.

It should also be noted that the seam lines 59 is incomplete at 60, and that side seam 61 and sleeve seam 62 do not come together. These portions of the seam line are left out purposely, because the floating dart 54 should be customized to the particular figure being fitted, and the angular orientation of this floating dart line will tend to alter the side seam and the sleeve seam in the missing areas. By leaving these areas out, the user is forced to customize the dart and fill the seams in during fitting, and this provides a better fit.

FIG. 2 shows a skirt front 44 having vertical reference lines 63 and the broadest flat width line 64 extending horizontally for assisting in the alteration procedure, together with the conventional darts and eases and indicated seam line 66. Similarly, back skirt 47 shown in FIG. 4 contains a horizontal line 67 indicating the broadest flat width and extending through the fitting reference point 52 indicating the high round of the seat. Horizontal lines 64 and 67 are at the same height on the figure and utilized for correction as indicated in the description of the procedure of this invention. FIG. 4 also contains vertical line 68, and conventional darts and eases together with the indicated seam line 69.

FIG. 3 shows a back bodice having horizontal lines 71 and 72 corresponding respectively with horizontal lines 56 and 57 of FIG. 1, i.e. at the same height level. FIG. 3 also contains a vertical line 73 together with the conventional darts and so forth and indicated seam line 74.

FIG. 5 shows a sleeve pattern having conventional darts and indicated seam line 76, and also width lines 77 and 78 and length line 79 as references for measurement and alteration of the pattern.

As indicated above, the initial seam lines are laid out as a standard, and when the person's figure has no unusual configurations, the pattern may be used without enlarging or reducing the internal area, but may be sized to fit exactly simply by readjusting the seam lines and tailoring the customed dart of the front bodice. In such cases, the pattern tool of this invention is still quite valuable because it does in fact tailor the darts and seams ahead of time so that the dressmaker will be able to proceed with confidence and obtain a good fit with a minimum of final alteration.

However, the plastic patterns of this invention are especially valuable as a tool where the user has a figure problem that requires changing of the pattern length or width, or enlargement or reduction of an internal area in order to fit non-standard lengths. Since the human body contains many many measurements, and the indicated seams must be within say about ⅝ of an inch from the actual measured seam when fitted at all points, the plastic sheet pattern will usually have to be altered. It should be appreciated that this ⅝ inch boundary is also arbitrary, and that improved tailoring can be achieved when the pattern is altered internally to accommodate certain smaller deviations.

When it comes to simple measurements of length and width, it is relatively easy to lengthen or widen, or conversely shorten or narrow the pattern to adjust for such gross changes on the pattern. However, a number of common figure problems require special alterations, and these figure problems are indicated in Table I below under appropriate numerals, which numerals are also shown on the patterns in FIGS. 1 through 5.

TABLE I

FRONT

1. Large bust
1a. Long span - bust to arm crease
Soft tissue - Hollow chest
2. Large waist or roll above
3. Large elbow
4. Protruding hip bone
5. Large tummy
6. Heavy forward leg muscle
7. Broad shoulder . . . square or high shoulder . . . forward shoulder bone

BACK

8. Protruding shoulder blade - Hi
9. Protruding shoulder blade - Lo
9a. Enlarged muscle or heavy flesh at back arm crease
10. Large waist or roll above
11. Hi-hip pad
11a. Sway Back
12. Heavy thigh
13. Large seat
14. Heavy upper arm
15. Broad shoulder . . . square or high shoulder . . . forward shoulder bone
16. Back curvature. Dowager's hump.

Figure 6:
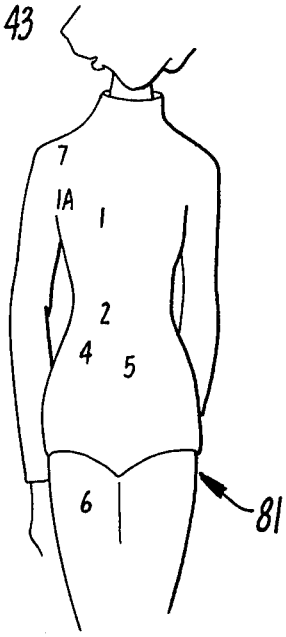
FIG. 6, a typical front view of a human figure indicating certain problem fitting areas.
Figure 7:
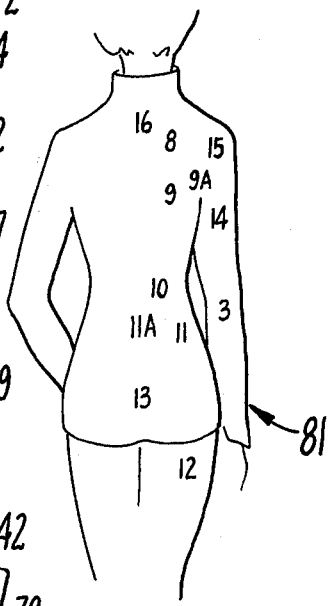
FIG. 7, a typical back view of a human figure indicating body areas having special fitting problems.

These reference numerals on the patterns of FIGS. 1 through 5 correspond to the similar reference numerals given in FIGS. 6 and 7 as located on the human body. In accordance with the invention, an instruction booklet is provided which will tell how to alter the patterns, where necessary, in order to correct any of these special problems, as well as how to lengthen or shorten certain areas of all of the pattern. While the reference numerals and instruction book are valuable as an aid, in the usual procedure of this invention, the problems will be normally indicated simply by following the procedure, and the seams corrected where deviations exceed ⅝ of an inch in accordance with the procedures shown herein. However, the instruction booklet is a valuable tool as well as the pattern forms, because it indicates all of these procedural instructions, as well as giving overall information for obtaining excellent custom fitting with this method and article of this invention.

Figure 13:
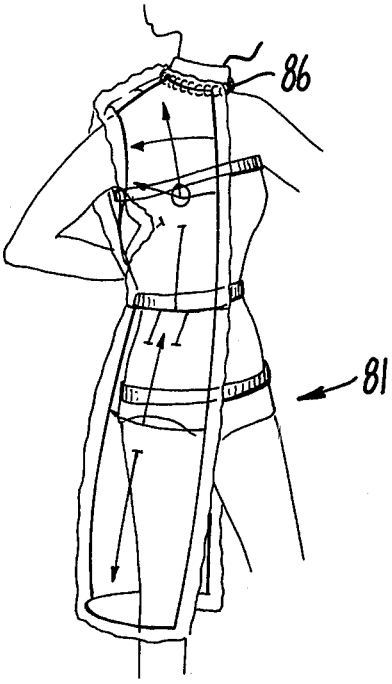
FIG. 13, a diagramatic view illustrating the fitting of the plastic patterns of FIGS. 1 through 4 to each other and on the human figure.

As best seen in FIG. 13, the plastic pieces of FIGS. 1 through 4 are first pinned together and located on the human figure 81. The plastic pieces are pinned together at the seams and pinned on reference tapes and/or under garments of the user so as to properly orient the pattern and accurately fix darts and seams. The sleeve of FIG. 5 is also pinned onto the form shown in FIG. 13 at a later stage, and the other side is fitted simply by turning the pattern inside out and marking the seams and so forth with a different colored ink.

As here shown, no collar pattern is presented, but it will be appreciated that the collar could be added, if desired. However, the important collar seams for fitting are indicated on the front and back bodice and these seams are all that are necessary in altering the pattern to be used. It will also be appreciated that all areas of the body are fitted, while certain styled garments will not have a close fit in one or more area. However, these style changes are simply incorporated by conventional dressmaking procedures and need not be described herein, since complete fitting measurements are indicated by the invention.

With the article comprising the main tool of this invention already indicated, the method of using the article or more specifically the method for fitting patterns to the human figure will not be described along with an indication of auxiliary tools provided in the preferred form. The user first procures one or more plastic sheets having the patterns indicated in FIGS. 1 through 5 for her indicated dress size. At the same time, a book of instructions are preferably obtained, although persons well skilled in the art would probably be able to make the necessary enlargements or deductions without resort to detailed procedural instructions. Since the present applicaton has as an object a method suitable for use by the lay dressmaker, the detailed procedures are generally needed at least in part. In addition, three tapes 82, 83 and 84 (see FIGS. 9 through 12) are cut from appropriate lengths of firm elastic ¾ inch wide for use as anchor bands. An adjustable encircling means in the form of a string, tape, chain or beads 86 are also provided in order to indicate the neckline so that the neck seams can be located.

Figure 8:
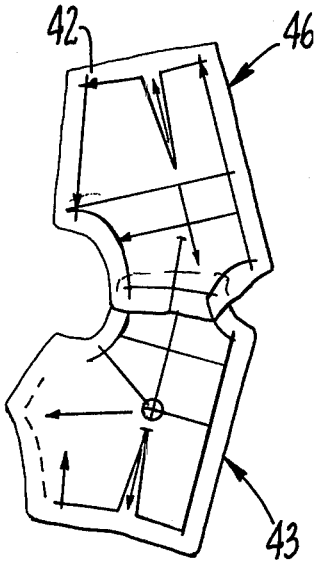
FIG. 8, a plan view showing attachment of the front and back bodice in an early procedural step conducted in accordance with the invention.

With all of the required articles at hand, the user first cuts the plastic sheet or sheets apart so that each pattern will be on an individual piece of plastic 42 as shown in FIGS. 1 through 5, with 1 inch extra plactic beyond indicated seam lines, except for the side seam of the front bodice, which should be two inches in order to allow for customizing the floating dart. Next the shoulder dart is pinned in back bodice 46, and back bodice 46 and front bodice 43 joined together along the shoulder seam as indicated in FIG. 8. It will be appreciated, that this step could be done shomewhat later, and that certain of the steps given in sequence may be altered. However, it will also be appreciated that various of the steps must be done in the sequence given in order to carry out the procedure of the invention. Such procedural variations will be obvious from the entire presentation.

Figure 9:
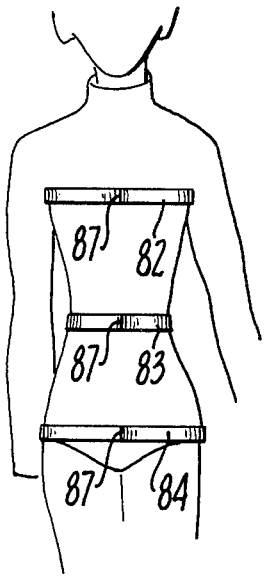
FIG. 9, a diagramatic view illustrating the placement of tapes on the human figure as seen from the front.
Figure 10:
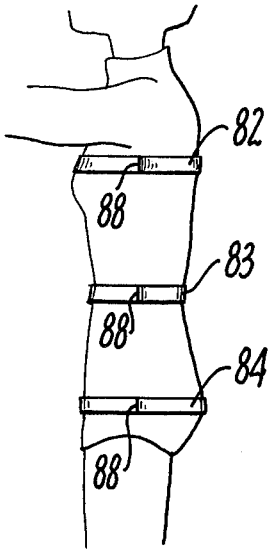
FIG. 10, a diagramatic view similar to that shown in FIG. 9, but illustrating the side position thereof.
Figure 11:
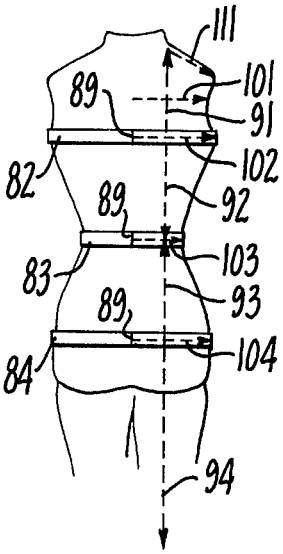
FIG. 11, a diagramatic back view illustrating how measurements are taken in accordance with the procedure of the invention.
Figure 12:
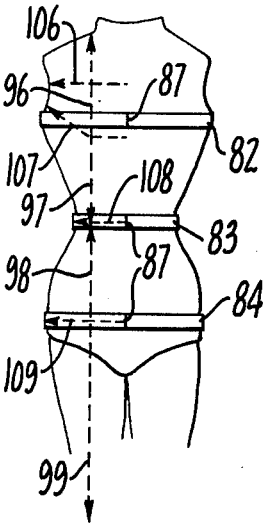
FIG. 12, a diagramatic front view further illustrating how measurements are taken in accordance with this invention.

Next the anchoring bands 82, 83 and 84 are located on the figure to be fitted, with the user wearing the undergarments expected to be worn under the garment to be made. Specifically, band 82 is a chest tape extending circumferentially around the figure in the underarm areas as shown, with the anchoring being achieved by the elastic nature of the band. However, each of these bands could also be pinned to undergarments, if desired. Band 83 is a waist tape extending circumferentially around the waist line, and band 84 is a hip tape extending circumferentially around the hips and through the high round areas of the seat. With the bands in place as shown in FIGS. 9 and 10, the front seam locations 87 are marked as shown in FIG. 9, side seam locations 88 are marked as shown in FIG. 10 and back seam locations 89 are marked as shown in FIG. 11. The seams are accurately aligned, and the side seam positons are determined by the armpit so that the side seam will be placed at the pivot position of the arm and the hip and the waist line is attractively divided at the sides.

The encircling means or beads 86 are then placed around the neck to determine the neck base, with the neck line marked and shoulder line marked from neck to shoulder using a felt pen and marked on the skin. In other words, the shoulder and neck seam is located on the figure being fitted in the orientation desired for proper fitting.

In accordance with the preferred form of the invention, the user will measure her figure, and lay out the measurements plus allowance on the plastic patterns. These measurements are made from the lower edges of the bands 82, 83 and 84 and in the directions indicated by the arrows shown in FIGS. 11 and 12. These measurements plus allowances are then laid out on the plastic patterns along the horizontal and vertical reference lines indicated thereon. The specific measurements plus allowances are shown in Table II below, along with the indicated arrows in FIGS. 11 and 12. The direction of measurement indicated is also used when pinning the plastic sheets as described below.

TABLE II

| | |
|---|---|
| BACK LENGTHS | |
| Broad back to shoulder | arrow 91 |
| Broad back to waistline | arrow 92 |
| Full hip to waistline | arrow 93 |
| Full hip to hemline | arrow 94 |
| FRONT LENGTHS | |
| Bust point to shoulder | arrow 96 |
| Bust point to waistline | arrow 97 |
| Full hip to waistline* | arrow 98 |
| Full hip to hemline* | arrow 99 |
| BACK WIDTHS | |
| Upper back-center to armhole | arrow 101 |
| Broad back to underarm + ¼" | arrow 102 |
| Waistline-center to side + ⅛" | arrow 103 |
| Full hip-center to side + ¼" | arrow 104 |
| FRONT WIDTHS | |
| Center to bust point | arrow 106 |
| Bust point to arm crease | arrow 107 |
| Waistline-center to side + ⅛" | arrow 108 |
| Full hip-center to side + ¼" | arrow 109 |

*Use same measurements as back skirt

In addition to the measurements tabulated above, the measurement along the shoulder seam as indicated by arrow 111 of FIG. 11 should also be made and the arm measured as follows: The length measurements are simply made by measuring the elbow to the shoulder and by measuring the elbow to the wrist and noting these length measurements. For the width, however, two fingers should be placed under the tape measure and the tape brought around the arm in order to prevent measuring too tightly. The full arm is measured, and 2 inches added to the measurement (said measurement corresponding to line 77 of the pattern on FIG. 5). The elbow is measured and 1½ inch added (this measurement corresponds to line 78 of FIG. 5). The wrist is measured and 1 inch added to the wrist (this indicates the lower seam of FIG. 5).

With all the measurements taken and allowances added, the measurements are laid out on the patterns printed on the plastic sheet 42. Note it is important to measure the lengths up and down from broad widths and reference marks and indicate the new seam line by marking. It may be noted that only certain seam areas are indicated by this method, but it is better not to overmark since these are the accurately located reference points and will serve to check the sizes necessary for new seam lines prior to the trying on step. Therefore, with these marks in place on the patterns of FIGS. 1 through 5, a comparison is made to see if the marks deviate very far from the standard seams indicated.

Figure 20:
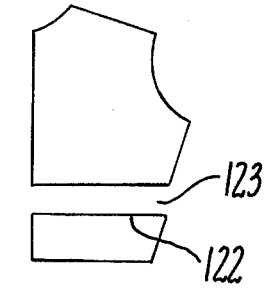
FIG. 20, a diagramatic view generally showing how to lengthen or shorten a pattern and specifically illustrating a manner of lengthening the waist portion of the back bodice.
Figure 21:
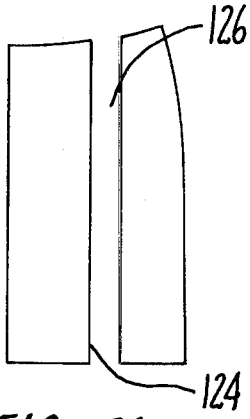
FIG. 21, a diagramatic view illustrating how to adjust the width of a pattern piece and specifically illustrating an increased width for the skirt back.
Figure 22:
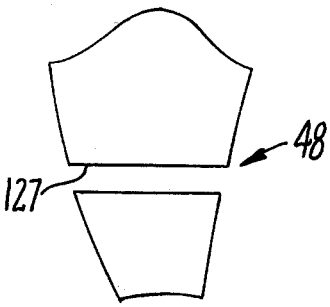
FIG. 22, a diagramatic view illustrating how to change the length of a sleeve and specifically illustrating an increased length thereof.

If the measured marks deviate by more than about ⅝ of an inch from the indicated seam line on the pattern, the pattern should be enlarged or reduced an amount sufficient so that the reference mark can be laid out approximately the same as the seam line. This ⅝ distance is arbitrary, and it will be appreciated that where such changes from say ⅝ oversize to ⅝ undersize occur rapidly, internal alteration of the plastic pattern is also indicated. When it is necessary to enlarge or reduce the length or width of any section of any pattern, the changes are made as illustrated in FIGS. 20 through 22 and described in greater detail below. If special problems of change occur in certain selected areas of the patterns, these special problems or pattern changes are corrected by enlarging or reducing the pattern as shown in FIGS. 23 through 40 of the drawing and also described in greater detail below.

With the reference markings being sufficiently close to the indicated seam lines, either by initialed measurement, or by remeasurement after appropriate size changes are made in the pattern, the plastic pieces are then fit on to the figure being measured.

As indicated in FIG. 8, the front and back bodice are first pinned at the shoulder seam, pins are also run through the corrected seam lines indicated by the measured mark rather than the original seam lines, with intermediate positions being pinned in alignment. The front and back skirt are pinned to the front and back bodice, with the darts taken in and eases adjusted so as to pin the various pieces together along the expected seam lines, and the side seam is pinned with the exception of a short section of the side seam under the arm. The plastic patterns thus pinned into a half dress without sleeve is then slipped on as shown in FIG. 13. The plastic is then pinned to the elastic tapes and otherwise attached for complete fitting. Some of the back positions are difficult to fit, and preferably an assistant will be utilized to assist in accurate location of the plastic patterns on the figure.

The plastic pattern is first pinned to the elastics by pinning the center back waist, center front waist, center back hip, center front hip, center back top elastic, and center front at chest elastic. Then the center front neck is taped and the center back neck is taped, the taping being accomplished with Scotch tape and being done to skin or sometimes to an undergarment. The shoulder is pinned to the bra strap and the fit is completed across the figure and up the side to waist and underarm area. The fit is refined by moving the pinned seam lines until the plastic sheets fit closely and properly against the body.

It is important that all of the fixed reference points are properly oriented when the plastique is fit, the horizontal lines 56 and 71 on the pattern should fall exactly at the lower edge of the chest elastic. For example, all of the high rounds must be accurately located, the waistline as indicated by the waist seam should fall at the lower edge of the waist elastic, and the broad width lines around the hips should fall at the lower edge of the hip elastic.

Figure 14A:
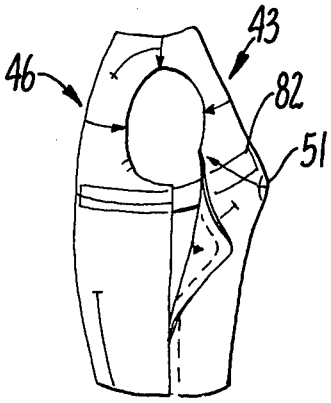
FIG. 14A, a diagramatic view illustrating how the front bodice is fitted with a floating dart customized at the chest area.
Figure 14B:
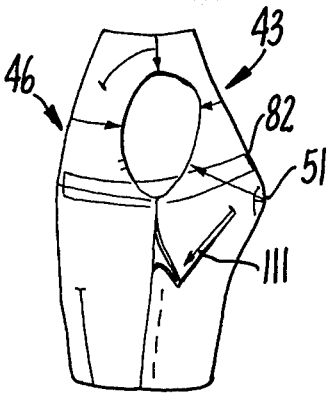
FIG. 14B, a view similar to FIG. 14A but illustrating the operation in a slightly later stage thereof.

With the plastic patterns all fit and pinned to the body and at the seams with the exception of the side seam under the arm, the floating dart is then drawn up as shown in FIGS. 14A and 14B. Specifically, the sheeting appears as shown in FIG. 14A, and the user starts about 1 inch away from the high round of the bust and works down the dart line to the side seam folding out excess plastic so as to create a fold as shown in FIG. 14B. The angle of the floating dart printed on bodice front 43 is generally right for most people, but the user should try higher and lower dart angles so as to locate the best dart angle for her own figure. The bust dart should be limited to 1½ inch pinch out (3 inch full dart width), and the chest width grain line should be kept straight. If more than 3 inch full dart width is taken up, it indicates that a problem such as that illustrated in FIG. 27 occurs that should be corrected by reducing some of the pattern area. With the floating dart thus customized, it is pinned along line 111 as shown in FIG. 14B, and the side seams pinning completed.

In fitting the plastic patterns to the body, any of the usual fitting techniques such as contouring the darts and creating eases may be utilized. For example, if the user has hips that jut out suddenly from the waist, the darts may be contoured or curved so that they are stitched narrower in the center than with the ordinary straight wedge--like dart.

After the plastic pieces shown in FIG. 13 are completely fitted and the custom dart located as shown in FIG. 14, the sleeve remains to be fitted. However, prior to fitting the sleeve, it should be reconciled to whatever changes were made in the armhole as a result of fitting the front and back, and FIGS. 15 through 19 show how the sleeve is reconciled. It will be understood also, that these changes are in addition to any changes of lengthening or widening that were made as a result of preliminary measurements.

Figure 15A:
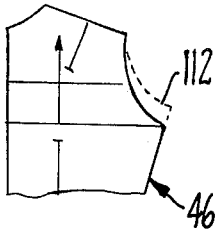
FIG. 15A, a view showing alteration in the sleeve area of the back bodice requiring reconciliation of the sleeve.
Figure 15B:
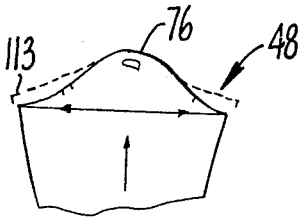
FIG. 15B, a diagramatic view of the sleeve showing the manner in which it is reconciled to the back bodice of FIG. 15A.
Figure 16A:
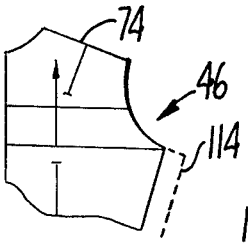
FIG. 16A shows an alteration in the side seam of the back bodice requiring a corresponding change in the sleeve.
Figure 16B:
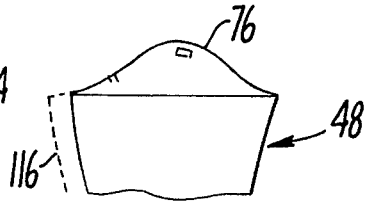
FIG. 16B, shows the alteration in the sleeve required to reconcile the sleeve to the change in back bodice shown in FIG. 16A.
Figure 17A:
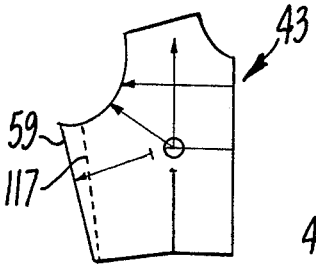
FIG. 17A shows a side seam decrease on the side seam of the front bodice requiring a change of the sleeve seam.
Figure 17B:
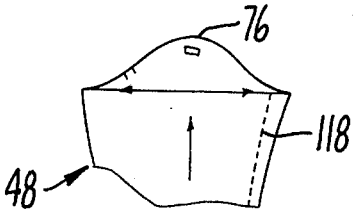
FIG. 17B, an illustration of the change of the sleeve made to reconcile the sleeve with the change shown in FIG. 17A.

A few rules should be adhered to in fitting sleeves. First of all, the underarm curve of the bodice must match the underarm curve of the sleeve and ¼ inch ease must be allowed on the back sleeve to ease into the bodice back. The front sleeve should have ⅛ inch more width to ease the sleeve into the bodice. In FIG. 15A, there is shown a raise in the back bodice 46 as shown by new seam 112. Accordingly, seam 76 of sleeve 48 is raised at 113 so as to change the curvature to match the changed curvature of the back bodice. In FIG. 16A, back bodice 46 is shown with seam 74 adjusted at 114, which adjustment was necessary in order to extend the back. However, seam 76 of sleeve 48 must similarly be extended and this is achieved by adjusting seam 76 at 116. FIG. 17A shows a shortening of front bodice 43 from original seam 59 to the dotted line 117 as shown. In order to reconcile sleeve 48, a corresponding decrease in seam 76 is provided by adjusting to the dotted line 118.

Figure 18A:
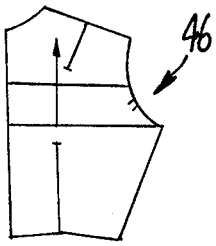
FIG. 18A, shows the back bodice as measured when not reconciled with the front bodice.
Figure 18B:
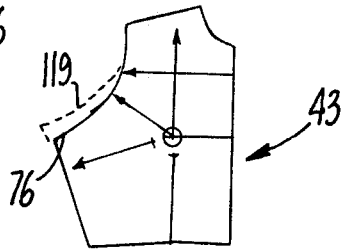
FIG. 18B, shows the front bodice which has its seam line changed during adjustment of the custom dart along the chest, and illustrates the manner of reconciling the side seam and sleeve seam with the back bodice.
Figure 19:
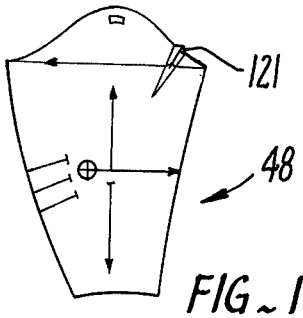
FIG. 19, a view illustrating an alteration of the sleeve wherein the sleeve is shortened to reconcile with the front and back bodice.

Assuming that part, all or none of these adjustments were required to reconcile the sleeve with the bodice, an adjustment of the armhole may also be required because of changes due to customizing the floating dart of the front bodice 43. Thus FIGS. 18A and 18B show bodice back 46 and bodice front 43 as they may be after customizing the floating dart. As there shown, the floating dart has brought seam line 76 down below the termination point of the side seam on the back bodice and a fill in of the indicated area 119 is necessary in order to bring the armhole back into the proper position. This is one of the purposes of the broken indicated seam line of the front bodice print as shown in FIG. 1, since failure to show the seam line, which will necessarily be determined by the floating dart, prevents confusion by the user. Of course, the change in what would be standard to the filled in seam 119 requires a shortening of the corresponding area of the sleeve, and this shortening is achieved by putting a tuck in sleeve 43 as shown in FIG. 19. These examples of changes and how same are reconciled do not cover all of the possible changes, but cover all changes in general so as to illustrate how all of the necessary changes may be made. For example, where additions are shown reductions can be achieved in reverse manner and where reductions are shown additions can be achieved in reverse manner.

With the sleeve reconciled and adjusted according to measurements, it too is pinned on and the seams carefully fitted by pinning. When doing so, the reference marks should be lined including notches, the high round of the elbow must be in proper position and the lengths should be checked carefully. In addition, the proper allowances should be made at the underarm so that the arm has a sufficient action and comfort.

After the plastic patterns are all fitted carefully pinned, they should be removed making sure that the patterns are all pinned together well at the seam lines and that all seams and dart lines are accurately indicated. Irregularities of the figure will show up quickly and such irregularities such a low shoulder or a high hip should be marked in another color for reference.

After the plastic patterns have been removed, the pins are removed, but during removal it is necessary to check carefully and make sure everything is marked well. The pattern pieces are then laid flat on the table and the seams and darts lines are trued-up. If any grain lines or centers are crooked they should be straightened out by removing the improper marks with polish remover and adding the proper marks with a felt pen. The altered sleeve should have the straight relocated by drawing a new line from underarm to underarm horizontally. A T-square or right angle should be referenced from this line and a new line drawn vertically from the sleeve cap to the wrist. No matter what alterations were made to the sleeve, this will give a correct straight of grain line. The center seam lines on skirts and bodices should also be straightened by placing straight edge from the extreme positions and redrawing the center line. The plastic patterns are now ready to be used to fit the paper patterns. Since the purpose of the plastic patterns is to take a cast of your figure and a plastic form, the finished fit should be a blue print for cutting the pattern so that any cut pattern will fit the figure to which the plastic sheets are adapted within the usual reaction tolerances of the fabric used.

Since the plastic patterns have been converted from a standard to a custom fit pattern, when they are used on paper patterns indicating styles and so forth, but otherwise standard for the same size, they will differ from the paper patterns in accordance with the adjustments and changes made in order to provide the proper fit. Accordingly, changes must be made in the paper patterns so as to line up the seam lines of the paper patterns with those of the plastic pattern seam lines with the usual alterations included to account for style change. In altering the paper pattern to effect such change, it is usual to simply make the same changes in the paper pattern as were made in the plastic pattern, although the paper pattern changes may differ, if desired, or where necessary due to styling.

Accordingly, FIGS. 20 through 40 which show methods of altering the internal pattern areas in order to accommodate figure deviations from the normal standard. It should be understood that these techniques are suitable for alterations in the plastic patterns and for alterations in the paper pattern.

FIGS. 20 through 22 show alterations made for changing the entire length or width of the pattern. In such cases, the patterns are enlarged or shortened by slashing and spreading or folding with the fold or spread being of consistant width throughout in order to maintain the straight of grain.

For example, FIG. 20, shows a lengthening of the bodice by cutting a line at 122, spreading the pattern to create space 123, and filling in the space by taping additional plastic or paper to the tow spread pieces. Shortening, of course, is achieved simply by cutting and overlapping at line 122 and taping the overlaped sections together. FIG. 21 shows a widening of the skirt by cutting a straight line 124, spreading the pattern sections apart in parallel fashion to create space 126, and taping a piece to fill in the spread pattern and make a unitary piece. Conversely the skirt section of FIG. 21 can be narrowed by cutting and overlapping along line 124 and taping the sections together, being careful to retain the shortened strip in parallel.

FIG. 22 shows a method of enlarging sleeve 48 by spreading same. A cut is made along line 127 which is parallel to grain line 78, and the pattern spread keeping the cut lines parallel and filled in as above. Conversely, shortening may be done by folding over as explained above. It will be understood that lengthening and widening should be achieved keeping in mind reference locations. Thus sleeve 122 may be lengthened above or below the high round of the elbow or both and the bodice may be similarly likened above or below the high round of the bust or both. In addition, it is possible to shorten one of these sections and lengthen the other so as to arrive at whatever changes are necessary to standardize the pattern to the person being fitted.

Figure 23A:
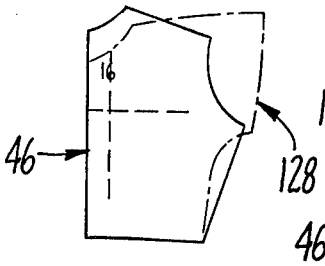
FIG. 23A, a diagramatic illustration of a fitting problem caused by the neck being too small, the shoulder being too low, and back too narrow, the problem being known as dowager's hump.
Figure 23B:
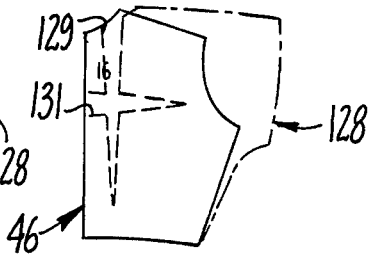
FIG. 23B, a diagramatic illustration of the manner of correcting the problem in 23A so that the plastic sheet and paper pattern fitted therefrom maintain the proper contours.

While lengthening and widening or reverse will take care of longer or shorter distortions from the normal, most figure problems cause contour changes that require special enlarging or reducing of the patterns. In the preferred procedure, the user should analyze her figure and indicate these probable problems, and the actual measurement and layout will confirm or deny such analyses. In addition, the layout will show the figure problems that the person may have missed. These figure problems are corrected by altering the internal size of the respective pattern to lift, enlarge and otherwise retain seams and provide sufficient internal material to retain proper contouring. FIG. 23 shows how to correct dowager's hump, the problem indicated herein by No. 16 on the pattern and on the figure. It requires correction of the bodice back and FIG. 23 shows how to correct a paper pattern 128 indicated in dotted lines to fit the plastic patten 46 already corrected and sized for the individual. The paper is slashed vertically along line 129 and horizontally along line 131 and spread so as to bring the paper seam lines in registry with the plastic seam lines. Additional pieces of paper are taped in the spread areas and the seam lines plus styling straightened so that the pattern is now ready for cutting.

Figure 24A:
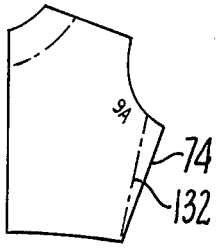
FIG. 24A, a diagramatic illustration of a fitting problem caused by a large muscle or heavy flesh at back arm crease.
Figure 24B:
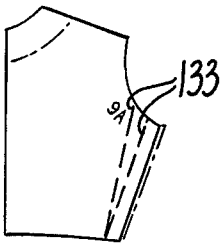
FIG. 24B, a diagramatic illustration of the size changes incorporated for correcting the problem shown in FIG. 24A.

FIG. 24 shows how to correct problem 9a caused by a large muscle so that the underarm of the pattern is too narrow. When the fitted plastic is placed over the paper pattern, paper pattern seam line 132 fails to match the corrected seam line 74 of the back bodice. Accordingly, the paper pattern should be slashed along a line parallel to the edge thereof and spread out in wedge shape manner with each side of the slash showing up at lines 133 of FIG. in 24B. The spread out section is then filled in or directly pinned to the fabric to be cut.

Figure 25A:
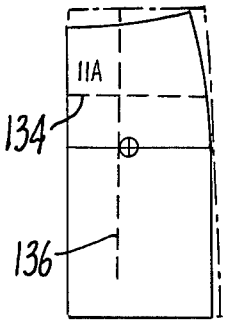
FIG. 25A, a diagramatic illustration of the fitting problem caused by swayback.
Figure 25B:
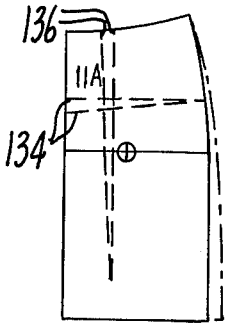
FIG. 25B, a diagramatic illustration of the corrected pattern sized to solve the problem of FIG. 25A.

FIG. 25 shows problem 11a or sway back. In such a case the skirt center is too long from broad width up to the waist and too full through high hip areas. In order to bring the paper pattern seam lines in the proper registry, slashes are made at lines 134 and 136, and the pattern overlapped at these slashes as indicated in FIG. 25B.

Figure 26A:
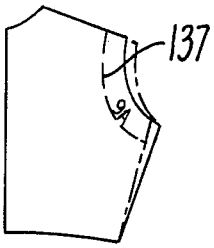
FIG. 26A, a view illustrating a combination figure problem where wide back and narrow shoulders are combined so that the pattern is too wide at the shoulder and too narrow at the broad back.
Figure 26B:
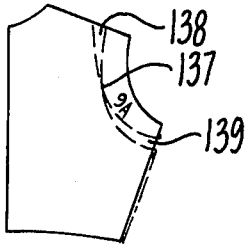
FIG. 26B, a figure showing the size changes on the pattern form utilized to correct the figure problem of FIG. 26A.

FIG. 26 indicates a combination figure problem caused by a wide back and narrow shoulders. The result is that the pattern is too wide at shoulder and too narrow at broad back. A slash is made at line 137 as indicated in FIG. 26A, and the paper pattern overlapped at 138 and spread at 139. This combination overlap and spread provides for the narrower shoulder and broader back simultaneously.

Figure 27A:
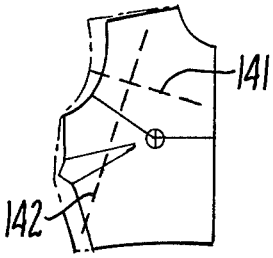
FIG. 27A, a diagramatic illustration of the front bodice mismatch occurring where the figure has a hollow chest and full bust.
Figure 27B:
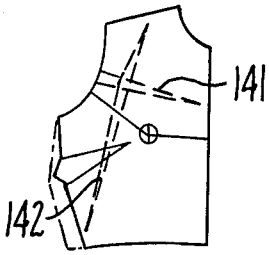
FIG. 27B, a diagramatic view of the pattern correction utilized to correct the problem of FIG. 27A.

FIG. 27 indicates how to correct for hollow chest and full bust (problem 1*a* in the references). The paper pattern is slashed diagonally through the armhole and above the bust round as in line 141 and also slashed diagonally from the neck line to the side seam but just short of each seam as shown in line 142. The pattern is then overlapped along each line as shown in FIG. 27B so as to bring the fitted seam lines in registry and leave the style allowance for the pattern. The effect of the slash and overlap is to shorten the armhole length and remove excess pattern from hollow area.

Figure 28:
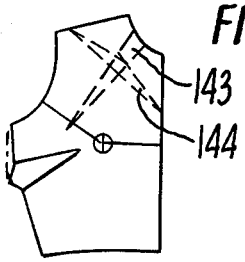
FIG. 28, a diagramatic illustration of the corrections utilized to solve the problem of gaping neckline.

FIG. 28 has to do with gaping neckline where there is too much diagonal length from the center front to the inner neck point of the shoulder seam. A first slash 143 is made from the neck diagonally and the second internal slash 144 is made crossways from slash 143 with the second slash stopping short of the seams. The pattern is then overlapped as indicated in the dotted lines in FIG. 28 so as to shorten the diagonal lengths and bring the material in closer to the neck.

These examples illustrate how certain conventional problems are solved, and the techniques illustrated herein for enlarging or reducing pattern areas show how further problems can be solved. However, in addition to the techniques for solving certain of the conventional problems and increasing or decreasing lengths and widths, certain techniques are applicable where limited areas of the pattern needs to be enlarged while leaving the other areas as is. FIG. 29 shows a series of enlargements from small to larger to illustrate the principal for adjusting limited areas throughout a range. Conversely, the same principals could be used for reducing the size with overlapping techniques.

Figure 29A:
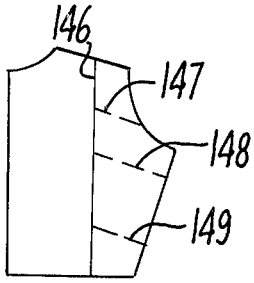
FIG. 29A, a diagramatic illustration of areas for changing the pattern sizes for the back bodice.
Figure 29B:
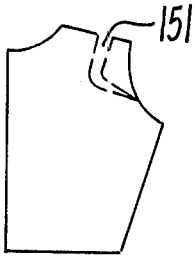
FIG. 29B, an illustration of increasing the back bodice within the plan shown in FIG. 29A in order to broaden the shoulder.
Figure 29C:
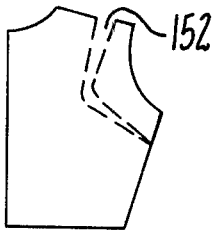
FIG. 29C, another alteration on the back bodice pattern within the scope of FIG. 29A and illustrating a combined broadening of the shoulder and underarm.
Figure 29D:
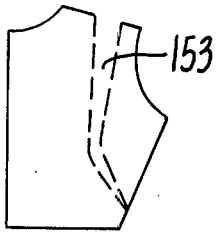
FIG. 29D, a figure similar to FIGS. 29B and 29C but in which the shoulders are broadened and the underarm and lower back are also broadened.
Figure 30:
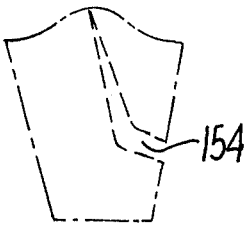
FIG. 30, an illustration of the pattern enlargement to accommodate a large elbow.
Figure 31:
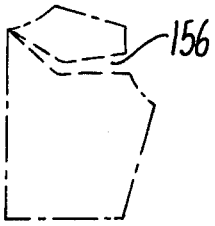
FIG. 31, an illustration of a pattern enlargement utilized to raise the shoulder.

Thus FIG. 29A shows indicated slash lines on the bodice which could be either the front or back bodice and including diagonal slashes. Specifically, vertical slash line 146 is shown together with diagonal slash lines 147, 148 and 149. In FIG. 29B, line 147 and the upper portion of line 146 is slashed and the open area 151 indicates the spread for the purpose of simply broadening the shoulder. FIG. 29C shows a similar broadening where diagonal lines 148 is slashed together with the upper section of line 146 and area 152 is opened up by spreading. This provides for broadening both the shoulder and the underarm. FIG. 29D shows a broadening of the shoulder, underarm, and lower back. This change is achieved by slashing diagonal line 149 and vertical line 146 above line 149, and spreading to create the enlarged area 153. FIG. 30 shows a slash and spread to add an area 154 to the sleeve and to correct for large elbow. FIG. 31 shows a slash and spread on the back to add area 156 and raise the shoulder.

Figure 32:
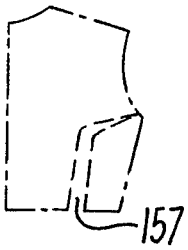
FIG. 32, an illustration of a pattern enlargement utilized to broaden the waist.
Figure 33:
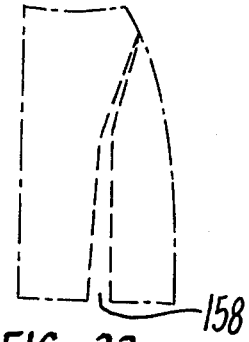
FIG. 33, an illustration of a pattern enlargement utilized to enlarge the pattern at the thigh area.
Figure 34:
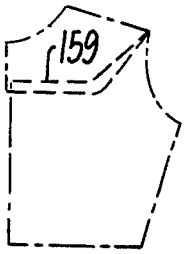
FIG. 34, a diagramatic view illustrating a method of decreasing the sides of the pattern to shorten the center back.
Figure 35:
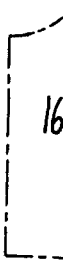
FIG. 35, a diagramatic view illustrating how the pattern may be decreased in area to accommodate narrow shoulders.

FIG. 32 shows another pair of slashes and spreading utilized to add area 157 and broaden the waist. FIG. 33 shows a pair of slashes and spread to add area 158 to the skirt and accommodate for a large size. In all of these cases of slashing and spreading to enlarge, slashing and overlapping will achieve the opposite or reduced area effect. For example, FIG. 34 shows a slash and overlap along line 159 to shorten the center back and FIG. 35 shows a slash and overlap along line 161 to narrow the shoulders. All of these latter techniques may be classified as alterations by use of angle slashes.

Figure 36A:
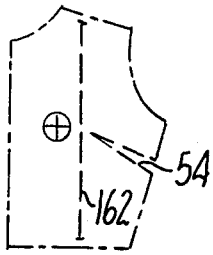
FIG. 36A, an illustration of the front bodice prior to correction for large bust.
Figure 36B:
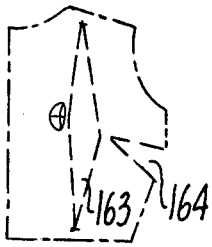
FIG. 36B, a view similar to 36A, but showing the correction made to solve a large bust problem.

FIG. 36 shows an example of pivot slashes and also indicates a correction for problem 1 or large bust. A slash is made along the floating dart line 54 and a vertical slash 162 is made between the end of the vertical dart line and the high round of the bust, but this vertical slash will go through the high round area. The plastic sheet is then spread to form area 163 and area 164 is indicated in FIG. 36B. This broadens the pattern over the bust and creates a deeper dart for more bust rise. If necessary, redraw the straight of fabric lines to correct distortions. As these pivot slashes provide enlarged areas to correct for large bust, the same slashes could be used for small busts by simply overlapping.

Figure 37A:
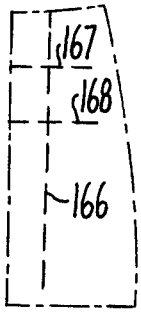
FIG. 37A, an illustration of enlargement in two directions utilized for correcting standard pattern to accommodate for a large seat or tummy.
Figure 37B:
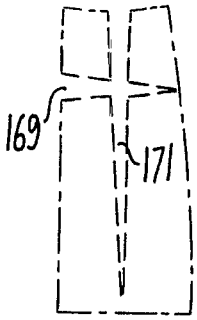
FIG. 37B, the view shown in 37A after enlargement to correct the problem indicated.

FIG. 37 shows the use of cross slashes for extreme problems such as problem No. 5 or 13 (large seat or tummy) in either case slash along vertical line 166 and also provide a cross slash. A cross slash along line 167 is used to correct for large tummey, and a cross slash along line 168 is used to correct for large seat. FIG. 37B shows added areas 169 and 171 resulting from the spread of these cross slashes and providing more material in the seat or tummy as required.

Figure 38A:
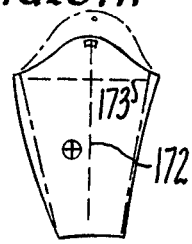
FIG. 38A illustrates a problem encountered when it is necessary to increase to a large extent the broad width of the sleeve.
Figure 38B:
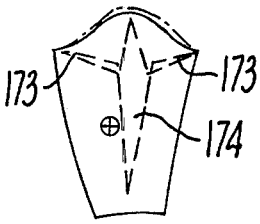
FIG. 38B, an illustration of the corrected broad width for solving the problem shown in FIG. 38A.
Figure 39A:
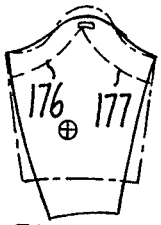
FIG. 39A an illustration of circular slashes used when a quick spread is needed in a short area.
Figure 39B:
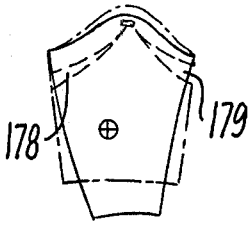
FIG. 39B, an illustration of the correction achieved by the circular slash and spread method of enlargement.
Figure 40A:
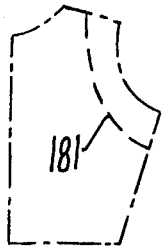
FIG. 40A, another illustration of a circular slash utilized to accommodate broadness at underarm and low underarm.
Figure 40B:
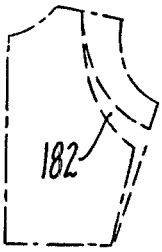
FIG. 40B, the pattern shown in FIG. 40A after the indicated correction.

FIG. 38 shows another example of cross slashes used for problem No. 14 (larger upper arm). Here slashes are made along lines of 172 and 173 as indicated in FIG. 38A. Line 172 is spread to provide area 174 as indicated in FIG. 38B while line 173 is overlapped. If this alteration brings the sleeve cap down too far, the slashes should be retaped and the circular slash technique illustrated in FIG. 39 should be used. FIG. 39 shows a way of providing a quick spread in a narrow area and it will solve the problem where the sleeve cap is too narrow for the arm and length is needed from the elbow to the underarm. As shown in FIG. 39A circular slash line 176 and 177 is made and these are spread to provide areas 178 and 179 as shown in FIG. 39B. Circular slashes are also used where the back or front is extremely broad at the underarm and the underarm is too low. Thus FIG. 40A shows a circular slash 181 and FIG. 40B shows the slash spread out to provide increased area 182.

Figure 41:
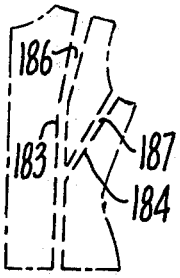
FIG. 41, an illustration of an extreme alteration indicating and illustrating the use of multiple enlargements.

From these examples, it is seen that the large and small areas of the pattern can be altered, and that most any alterations can be made in the plastic pattern to bring it into conformity with the figure being fitted. It is also seen that similar alterations can be made in any selected paper pattern to bring it into conformity with the plastic pattern. Since the enlargement or reduction is geometric in nature, a good eye for area changes is valuable, but anyone can become skilled at making these alterations simply by following the directions and gaining a certain amount of practice. Although most of the illustrations are given individually, it will be appreciated that all sorts of combinations of alterations can be provided, the important objective being to reshape the patterns to fit the contours of the body in accordance with the best possible fitting relationship. For example, FIG. 41 shows a multiple alteration where two slashes 183 and 184 are made to provide two increased areas 186 and 187. The enlargements herein are obvious, and conversely reductions could be made, if desired.

From the foregoing description, it is seen that I have provided a valuable and complete fitting tool and method of using same whereby people with various figure deviations from the norm are able to transfer their fitting dimensions both as to size and shape to a plastic pattern tool, which in turn may be utilized to adjust paper patterns so as to provide proper cuts for excellent customized fitting.

I claim:

1. A method of fitting patterns to a human figure, comprising:

a. attaching tapes to the figure being fitted at the waist and at the high around areas of the bust and seat, b. marking the front, back and side seam locations on each of said tapes, c. measuring front and back lengths between tapes and front and back widths between seam locations, d. providing a plurality of transparent plastic sheet materials having basic clothing pattern sections imprinted thereon, said plastic pattern sections having:

i. indicia showing fixed reference points, some of which indicate the location of selected high round areas of the figure and other of which locate areas and serve as reference points for enlarging or reducing said plastic pattern sections in said areas, and ii. correctable reference markings including seam lines and markings indicating areas for locating darts, e. transferring the measured lengths and widths to the plastic pattern sections, f. altering the plastic pattern sections in accordance with the measured lengths and widths from the figure, g. joining plastic pattern sections together in a non-permanent manner to form a partial garment and placing it over the figure, h. aligning said partial garment of plastic pattern sections to the figure by means of said some fixed reference points, enlarging or reducing said plastic pattern sections in said areas indicated by said other fixed reference points and further adjusting the plastic pattern sections relative to each other as required to determine proper dart and seam lines for an accurate fit of the figure, and i. removing the plastic pattern sections from the figure, separating the sections and further marking the sections with the indicated dart and seam lines to produce a set of custom-tailored clothing patterns.

2. A method of fitting patterns to a figure as defined in claim 1, which also comprises:

a. Overlaying the plastic sheets on a selected paper pattern, adjusting the size of the paper pattern in a manner similar to the adjustment made on the plastic pattern sections to bring the seam lines of the paper pattern in close proximity to the indicated seam lines on the plastic pattern sections, b. Correcting seam lines of the paper pattern so as to conform with the seam lines on the plastic pattern sections, and c. Utilizing the paper patterns to cut and sew material in conventional fashion to provide a finished garment.

* * * * *